US007631954B2

(12) United States Patent
Conway et al.

(10) Patent No.: US 7,631,954 B2
(45) Date of Patent: Dec. 15, 2009

(54) DELIVERY PRESSURE COMPENSATION METHODS AND APPARATUSES

(75) Inventors: John Yeung Conway, Louisville, KY (US); Angela L. Hudson, Mount Sterling, KY (US)

(73) Assignee: Lexmark International, Inc., Lexington, KY (US)

( * ) Notice: Subject to any disclaimer, the term of this patent is extended or adjusted under 35 U.S.C. 154(b) by 101 days.

(21) Appl. No.: 11/764,508

(22) Filed: Jun. 18, 2007

(65) Prior Publication Data

US 2008/0309689 A1 Dec. 18, 2008

(51) Int. Cl.
*B41J 2/195* (2006.01)

(52) U.S. Cl. ..... 347/7; 347/14; 347/19

(58) Field of Classification Search ..... 347/7, 347/14, 19
See application file for complete search history.

(56) References Cited

U.S. PATENT DOCUMENTS 5,682,183 A * 10/1997 Wade et al. ..... 347/7
5,706,037 A * 1/1998 McIntyre ..... 347/3
6,126,266 A * 10/2000 Numata et al. ..... 347/23

* cited by examiner

*Primary Examiner*—Thinh H Nguyen
(74) *Attorney, Agent, or Firm*—Taylor & Aust, PC

(57) ABSTRACT

Methods and apparatuses for compensating for changes in delivery pressure and protection of a printhead against increased ink flow resistance caused by air trapped in the felt or foam are described. In an exemplary embodiment, ink ejection flow rates are adjusted to keep delivery pressures safely at or below the maximum sustainable delivery pressure required to protect a micro-fluid ejection device of a printhead assembly.

17 Claims, 7 Drawing Sheets

DELIVERY PRESSURE COMPENSATION METHODS AND APPARATUSES

FIELD OF THE INVENTION

The present invention relates to ink jet printing, and, more particularly, to methods and apparatuses for protecting a micro-fluid ejection device against changes in fluid delivery pressures caused by air trapped in felt or foam.

BACK GROUND OF THE INVENTION

An imaging apparatus, such as an ink jet printer, forms an image on a print medium, such as paper, by applying ink to the print medium. The ink may be contained in one or more replaceable supply cartridges. Examples of such replaceable supply cartridges include a replaceable ink tank and an ink jet printhead cartridge. An ink jet printhead cartridge, for example, includes both an ink tank and a printhead (e.g., an ink jet micro-fluid ejection device) in a unitary device. In contrast, a replaceable ink tank is indirectly coupled via a fluid interface to a separate micro-fluid ejection device, and wherein the micro-fluid ejection device forms part of a printhead assembly that is separately attached to the printhead carrier.

Each supply cartridge used by an ink jet printer will have a certain ink volume. Continued printing beyond the intended delivery volume causes delivery pressures to increase dramatically. These high delivery pressures inhibit ink flow to the nozzles of the printhead, and instead of ink flow, air will be ingested into the printhead through the nozzles. As a result, the life of the printhead may be drastically shortened.

One such ink jet printer includes an ink tank system, and mounts a plurality of ink tanks, with each ink tank containing a supply of a particular color of ink, e.g., black, cyan, magenta, and yellow. Each ink tank is mounted to a micro-fluid ejection device that is separately mounted to the printhead carrier, and is commonly referred to as an on-carrier ink tank system. In an on-carrier ink tank system, for example, the ink is transferred from the ink tank to the micro-fluid ejection device through as series of fluid interfaces, e.g., a felt ink retaining member located in the ink tank and a wick located on the printhead assembly.

A typical ink tank includes a free ink chamber separated from a felt chamber by a dividing wall. The felt chamber has inserted therein the felt ink retaining member. The divider wall between the free ink chamber and the felt chamber has an ink communication port, sometimes referred to in the art as a "bubbler window", to allow transfer of air and ink between the two chambers. The term "bubbling" refers to the process of air and liquid exchange through the communication port, aka "bubbler window". Air enters the free ink chamber, which in turn allows ink from the free ink chamber to move into the felt chamber.

The felted chamber is used to maintain a constant pressure while the free ink drains from the free ink chamber. Typically speaking, an ink tank has reached its end of life when the free ink is completely drained from the free ink chamber. However, even after the free ink is out, a deliverable reserve of ink remains in the felt. This reserve is depleted when the delivery pressure equals the maximum pressure the printhead can sustain without ingesting air. Utilizing this reserve has advantages and disadvantages. If the free ink is depleted in the middle of a print job, the reserve can be used to complete the job. However, when the reserve is used the felt naturally ingests air as the ink drains. This air ingestion is not a concern if the current ink tank is replaced by a new ink tank. However, this ingesting of air may pose a problem when a user opts to refill the tank in lieu of purchasing a new tank.

The addition of new ink into an ink tank complicates ink flow, especially if air was ingested into the felt. Experiments have shown that the majority of this air remains trapped in the felt after new ink is added. The air trapped in the felt increased ink flow resistance through the felt and jeopardizes the micro-fluid ejection printhead.

SUMMARY OF THE INVENTION

Methods and apparatuses for compensating for changes in delivery pressure and protection of a printhead against increased ink flow resistance caused by air trapped in the felt or foam are described. In an exemplary embodiment, ink ejection flow rates are adjusted to keep delivery pressures safely at or below the maximum sustainable delivery pressure required to protect a micro-fluid ejection device of a printhead assembly.

In one exemplary embodiment, a method is described that includes starting a print job; detecting whether free ink is present in a supply cartridge; if free ink is detected, and a memory device associated with the supply cartridge indicates no free ink is available, then designating the supply cartridge as having had new ink added; reducing a print speed from a normal print speed associated with the original fill to a new print speed required to protect the printhead; printing a page of the print job at the adjusted print speed; again detecting whether free ink is present in a supply cartridge; and if no free ink is detected, utilizing a reserve amount of ink that remains in an ink suspension body of the supply cartridge to continue printing the print job at the adjusted print speed.

The invention, in another form thereof, is directed to an imaging apparatus. The imaging apparatus includes a print engine having a printhead carrier. A printhead assembly is configured to be mounted to the printhead carrier. A removable ink tank is configured to be mounted to the printhead assembly. The removable ink tank includes a free ink chamber and a suspended ink chamber. The suspended ink chamber has an ink output port and contains an ink suspension body. The suspended ink chamber is separated from the free ink chamber by a divider wall. The divider wall has an ink communication port to facilitate fluid communication between the free ink chamber and the suspended ink chamber. The output port is in fluid communication with the printhead assembly. A memory is associated with the removable ink tank. A controller is communicatively coupled to the print engine, the printhead assembly, and the memory. The controller executes program instructions for determining whether the removable ink tank has had new ink added, wherein: if the removable ink tank has had ink added, then printing is performed at a normal ink ejection rate, and if the removable ink tank has had new ink added, then printing is performed at an adjusted ink ejection rate that protects the micro-fluid ejection device.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DESCRIPTION OF THE PREFERRED EMBODIMENT

Figure 1:
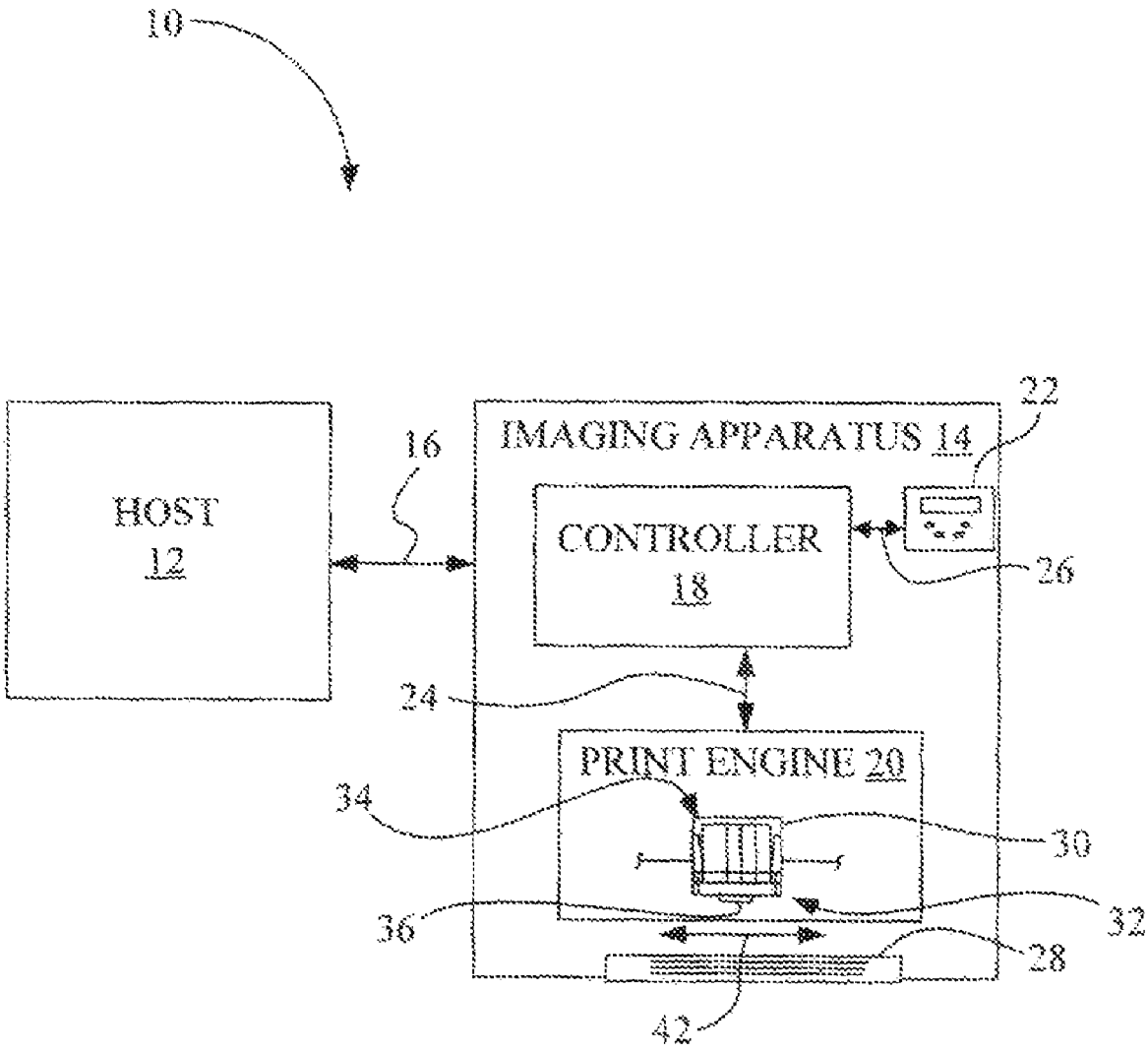
FIG. 1 is a diagrammatic depiction of an imaging system embodying the present invention.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 via a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30.

Figure 2:
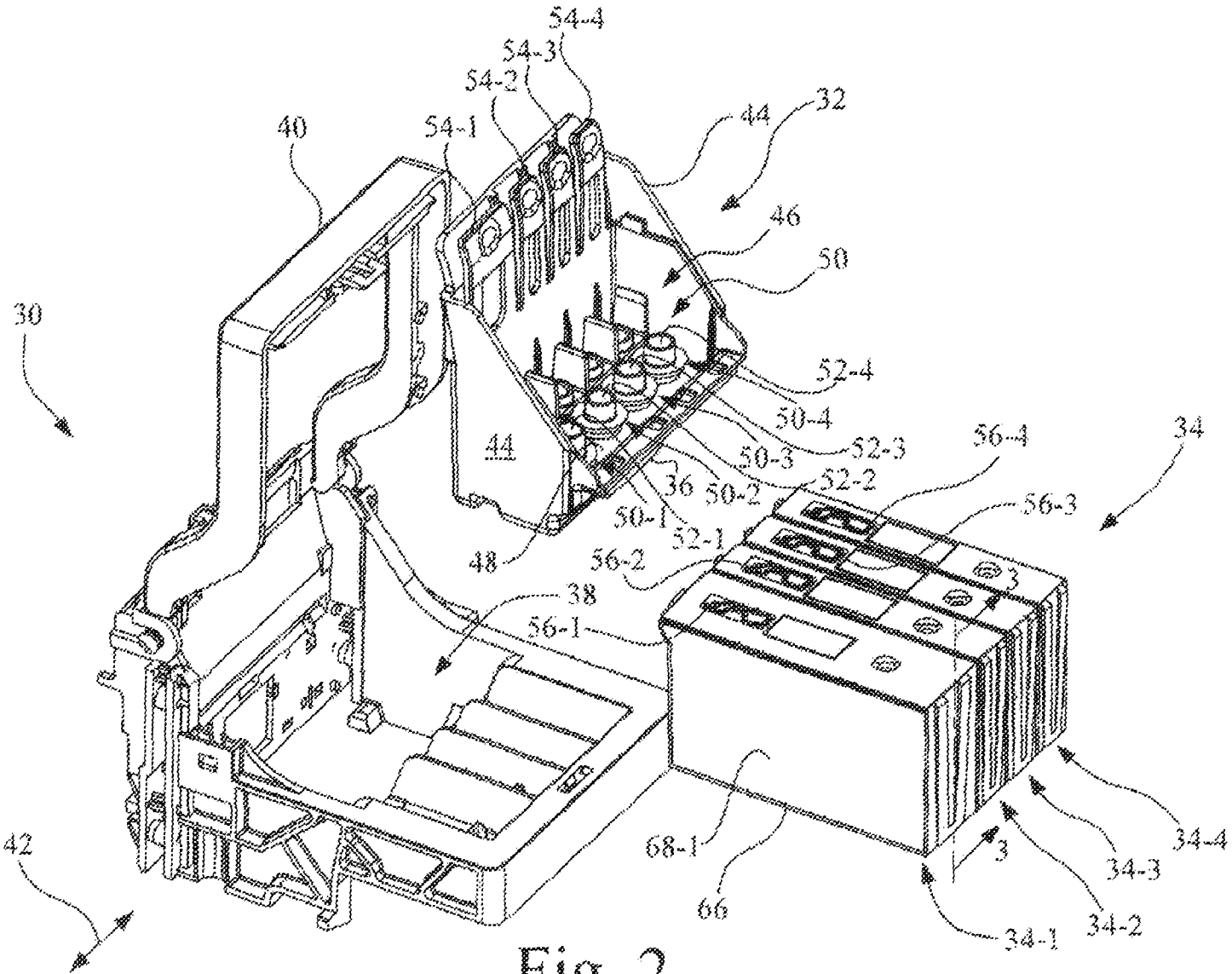
FIG. 2 is a perspective view of the printhead carrier of FIG. 1, with the printhead assembly and ink tanks uninstalled.

FIG. 2 shows in a perspective view printhead carrier 30, with a printhead assembly 32 and a plurality of removable ink tanks 34 in an uninstalled state. Printhead carrier 30 is mechanically and electrically configured to mount and carry at least one printhead assembly 32 that includes at least one printhead, e.g., ink jet micro-fluid ejection device 36, and is communicatively coupled to controller 18 via communications link 24. Printhead assembly 32 is mounted into position to printhead carrier 30 by inserting printhead assembly 32 into a cavity 38 in printhead carrier 30, and is latched in position by a mounting lever 40. Printhead carrier 30 transports printhead assembly 32, and in turn ink jet micro-fluid ejection device 36, in a reciprocating manner in a bi-directional main scan direction, i.e., axis, 42 over an image surface of the sheet of print media 28 during a printing operation.

Printhead assembly 32 is configured to mount and carry the plurality of removable ink tanks 34, and to facilitate an ink transfer from one or more of the plurality of removable ink tanks 34 to micro-fluid ejection device 36. The plurality of removable ink tanks 34 may be made, for example, from plastic. The plurality of ink tanks 34 are individually identified as ink tanks 34-1, 34-2, 34-3 and 34-4, and may include a monochrome ink tank containing black ink, and three color ink tanks containing cyan, magenta, and yellow inks. Micro-fluid ejection device 36 may include an ink jet nozzle array for each color of ink.

In the present embodiment, each of ink tanks 34-1, 34-2, 34-3 and 34-4 form a respective supply cartridge that is removably mounted to printhead assembly 32. Those skilled in the art, however, will recognize that a unitary supply cartridge may be formed by the combination of the ink tank(s) with the printhead assembly to form an ink jet printhead cartridge. As used herein, the term "supply cartridge" includes both an ink tank that is separable from a printhead assembly, as well as a unitary ink jet printhead cartridge that integrally combines the ink tank and printhead as a non-separable unit.

Printhead assembly 32 includes a printhead body 44 and a filter cap 46. Those skilled in the art will recognize that some printhead assemblies may not include a filter cap. Micro-fluid ejection device 36 is attached to a snout portion of printhead body 44. Filter cap 46 is attached to printhead body 44 via a hermetic seal, such as by welding or adhesive attachment. Filter cap 46 has a filter cap body 48 configured with a plurality of ink receiving devices 50, individually identified as ink receiving device 50-1, ink receiving device 50-2, ink receiving device 50-3, and ink receiving device 50-4. Each ink receiving device 50-1, 50-2, 50-3, and 50-4 includes a respective wick 52-1, 52-2, 52-3, and 52-4 that operably engages and facilitates fluid communication with the respective ink output ports of ink tanks 34-1, 34-2, 34-3 and 34-4, respectively. Each of wicks 52-1, 52-2, 52-3, and 52-4 may be constructed from a porous material, such as for example, from a porous felt material or a porous foam material. Also, those skilled in the art will recognize that some printhead assemblies may not include a wick.

Associated with each of ink tanks 34-1, 34-2, 34-3 and 34-4 is a respective memory device 56-1, 56-2, 56-3, 56-4, such as for example, a memory chip or an RFID circuit, that is communicatively coupled to controller 18 via communications link 24 (see FIG. 1).

Ink tanks 34-1, 34-2, 34-3 and 34-4 are individually mounted to printhead assembly 32 via individual ink tank latches 54-1, 54-2, 54-3 and 54-4. Actuating, e.g., deflecting, a respective ink tank latch 54-1, 54-2, 54-3 and 54-4, releases a respective ink tank 34-1, 34-2, 34-3, 34-4 to allow removal of the respective ink tank 34-1, 34-2, 34-3, 34-4 from printhead assembly 32, and more particularly from printhead body 44.

Figure 3:
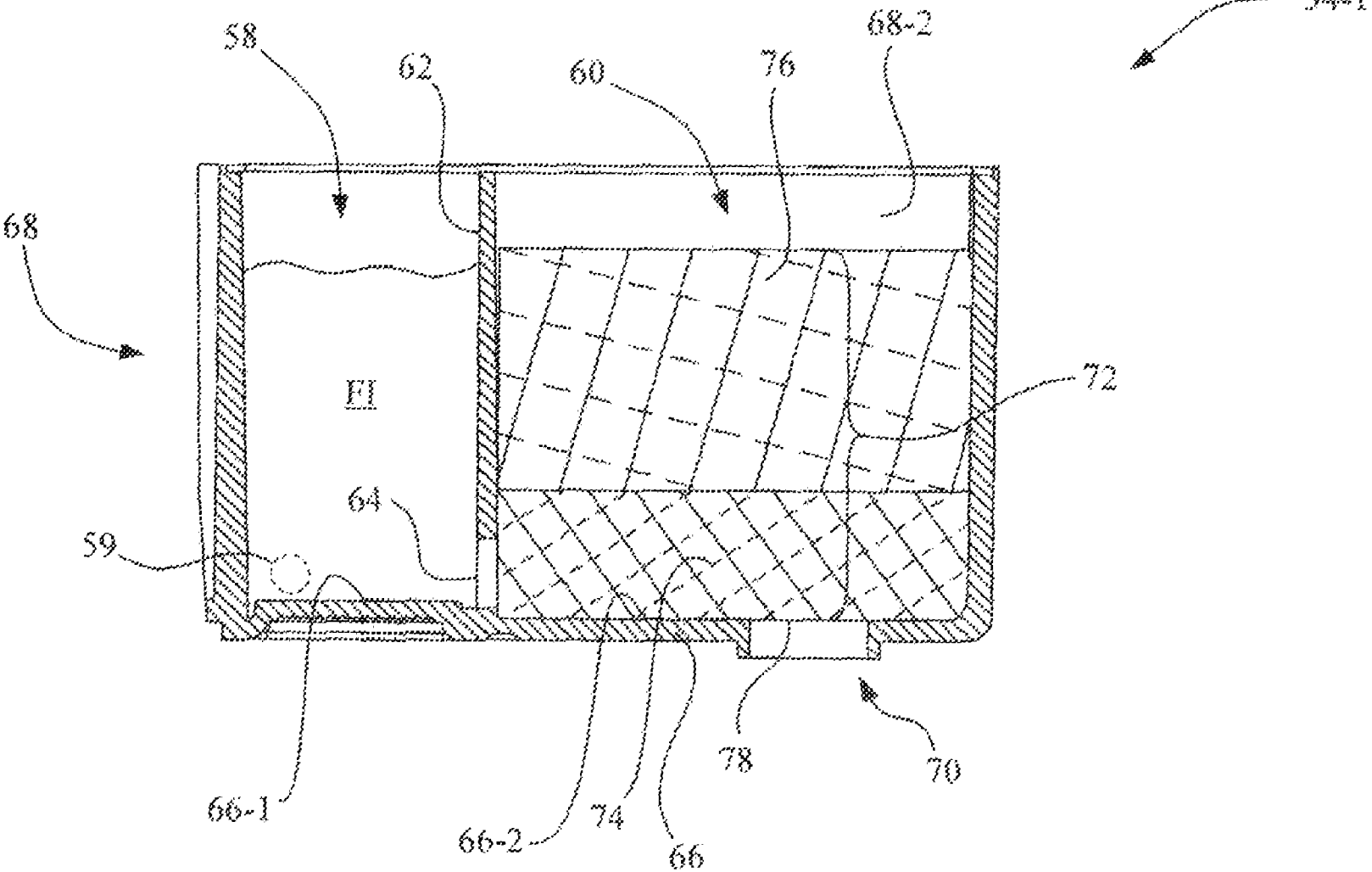
FIG. 3 is a sectional view of one of the removable ink tanks of FIG. 2 taken along line 3-3.

FIG. 3 is a section view taken along line 3-3 of one of the removable ink tanks 34, and in particular, ink tank 34-1 in this example. Each of removable ink tanks 34 are similar in design, varying only in size in the present embodiment. Accordingly, for convenience and ease of discussion, the following description will specifically reference ink tank 34-1, hut those skilled in the art will recognize that the description may be applied equally to each of ink tank 34-2, ink tank 34-3, and ink tank 34-4.

Ink tank 34-1 includes a free ink chamber 58 and a suspended ink chamber 60. Associated with free ink chamber 58 is an ink sensor 59. Ink sensor 59 may be, for example, an optical sensor. Free ink chamber 58 includes a free-flowing supply of ink FI, referred to herein as free ink, and is positioned adjacent to suspended ink chamber 60. Free ink chamber 58 is separated from suspended ink chamber 60 by a divider wall 62. Divider wall 62 has an ink communication port, i.e., bubbler window, 64 to provide fluid communication between free ink chamber 58 and suspended ink chamber 60.

Ink tank 34-1 has a floor 66, and a plurality of side walls 68, for example, a first side wall 68-1 and a second side 68-2, extending upwardly away from floor 66. Side wall 68-2 is separated from side wall 68-1, with divider wall 62 being interposed between and connected to each of side wall 68-1 and side wall 68-2. In the present embodiment, ink communication port, i.e., bubbler window, 64 is located in a lower portion of divider wall 62 near floor 66.

Floor 66 includes a first floor portion 66-1 and a second floor portion 66-2. Free ink chamber 58 is located over first floor portion 66-1 of floor 66. Suspended ink chamber 60 is located over second floor portion 66-2 of floor 66 around an ink output port 70 formed through second floor portion 66-2 of floor 66. Ink output port 70 facilitates fluid communication with printhead assembly 32 when ink tank 34-1 is installed on printhead assembly 32.

Positioned in suspended ink chamber 60 is an ink suspension body 72 that provides a restriction to prevent a free-flow of ink through suspended ink chamber 60 to ink output port 70 and produce a negative pressure. In the present embodiment, ink suspension body 72 may include, for example, a lower ink suspension body 74 and an upper ink suspension body 76. In this example, lower ink suspension body 74 is positioned adjacent to floor 66. Upper ink suspension body 76 is positioned in suspended ink chamber 60 adjacent to and above lower ink suspension body 74. Each of lower ink suspension body 74 and upper ink suspension body 76 may be constructed from a porous material, such as for example, from a porous felt material or a porous foam material. Lower ink suspension body 74 has a porous ink transfer surface 78 positioned above ink output port 70, which is engaged and deflected by ink receiving device 50-1 and its associated wick 52-1 when ink tank 34-1 is installed in printhead assembly 32.

In the present embodiment, lower ink suspension body 74 and an upper ink suspension body 76 may be configured with materials having different porosities. Alternatively, ink suspension body 72 may be formed from a single unitary porous material, if desired.

Figure 4:
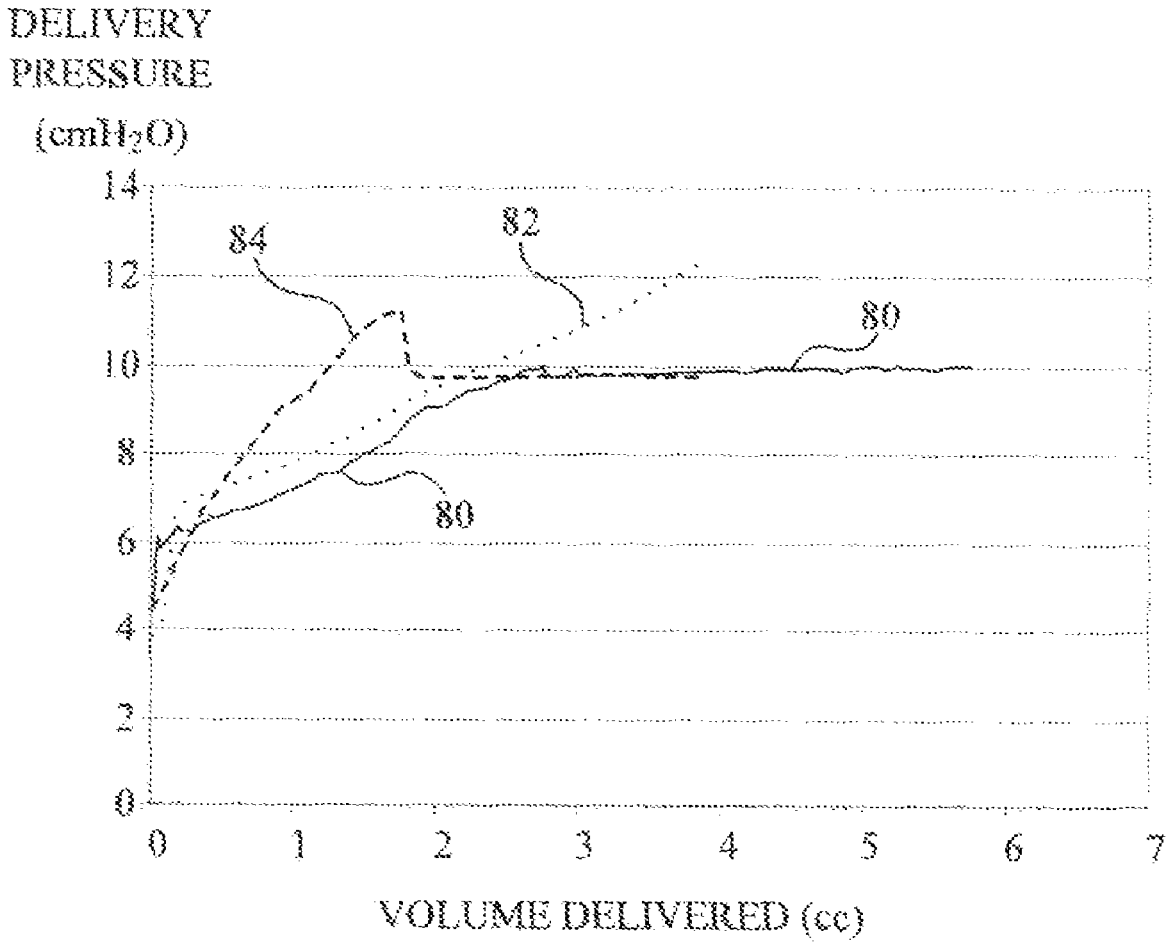
FIG. 4 is a graph that plots volume delivered (X-axis) to delivery pressure (Y-axis) for three different conditions.

FIG. 4 is a graph that plots ink volume delivered (in cubic centimeters (cc); X-axis) to delivery pressure (in centimeters of water column ($cmH_2O$); Y-axis) for three different conditions. The first condition is represented by plot 80, and is associated with the original fill of ink tank 34-1 at an ink ejection rate of 5 milligrams per second (mg/sec). The second condition is represented by plot 82, and represents a refill of ink tank 34-1 at an ink ejection rate of 5 mg/sec. Plot 84 represents the same refill of ink tank 34-1, but at an ink ejection rate of 1.5 mg/sec. The ink ejection rate is the rate at which ink is expelled through micro-fluid election device 36 of printhead assembly 32. The ink ejection rate is determined, at least in part, on the print speed of imaging apparatus 14, such as for example, the velocity (speed) at which printhead carrier 30 reciprocates along bi-directional main scan direction (axis) 42 during printing.

As used herein, the term "normal ink ejection rate" is the ink ejection rate of an ink tank and associated printhead assembly, e.g., ink tank 34-1 and printhead assembly 32, with the ink tank containing the original fill of ink. The term "refill ink ejection rate" is the ink ejection rate of an ink tank and associated printhead assembly, e.g., ink tank 34-1 and printhead assembly 32, with the ink tank having been refilled with ink to replenish the ink supply in the ink tank after the original fill has been significantly depleted.

Plot 80 demonstrates that the maximum sustainable delivery pressure for ink tank 34-1 with the original fill is 10 $cmH_2O$ at a 5 mg/sec ink ejection rate. However, as demonstrated by plot 82, the same ink tank 34-1 after refill will exceed the maximum sustainable delivery pressure 10 $cmH_2O$ at a 5 mg/sec ink ejection rate, e.g., will only drain from ink suspension body 72 at 5 mg/sec ink ejection rate since the flow resistance from the free ink chamber 58 to ink output port 70 is too high, thus in effect blocking the flow from free ink chamber 58 into suspended ink chamber 60. As demonstrated by plot 84, equivalent delivery pressures to those of plot 80, i.e., at the maximum sustainable delivery pressure of 10 $cmH_2O$, are not experienced unless the flow rate is reduced to 1.5 mg/sec. In the present example, the ratio of ink ejection rate reduction is 1.5 to 5, or 30 percent of the ink ejection rate of the original fill of ink tank 34-1.

Figure 5:
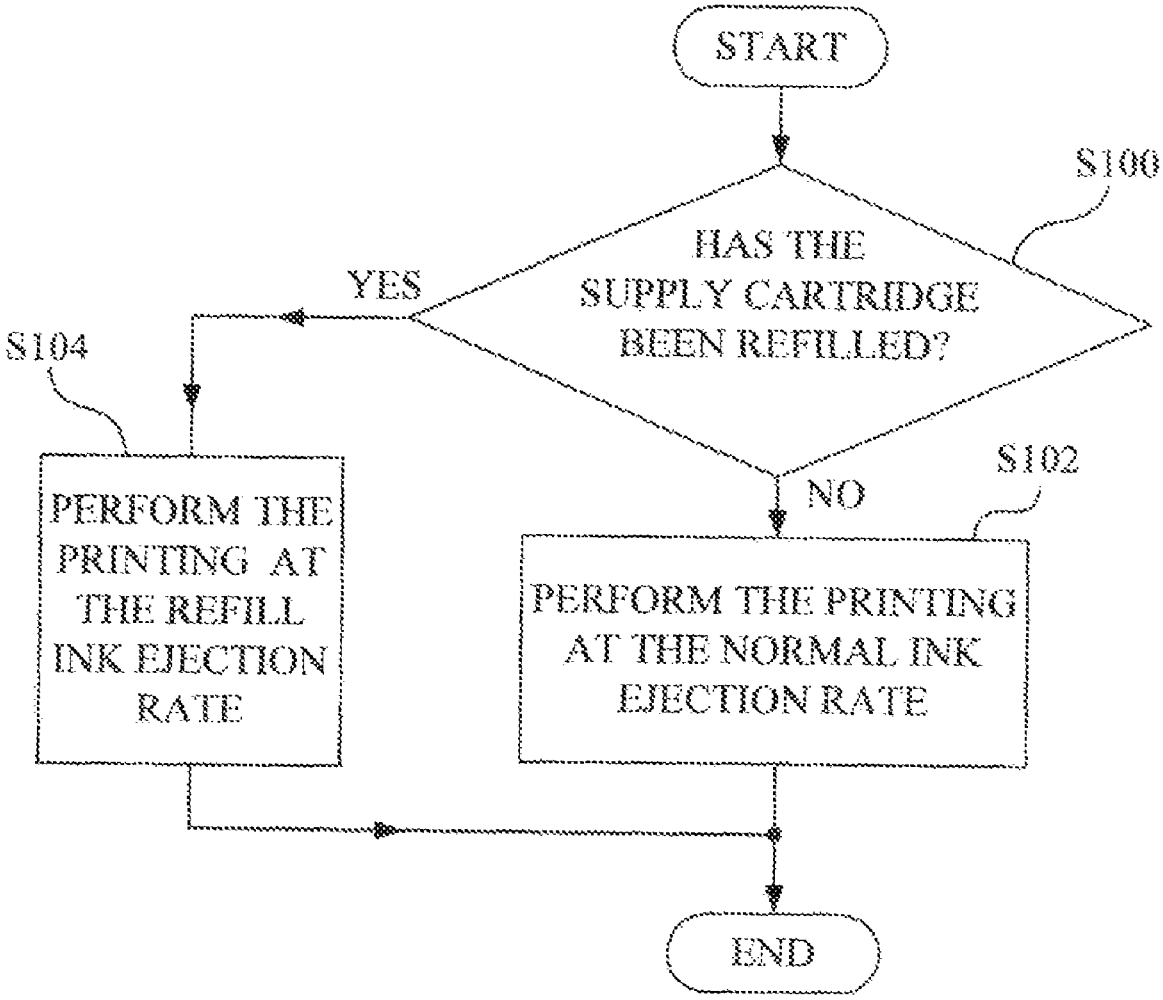
FIG. 5 is a general flowchart of a method for compensating for a refill of a supply cartridge, such as an ink tank, in accordance with an embodiment of the present invention.

FIG. 5 is a general flowchart of a method for compensating for a refilled supply cartridge, such as ink tank 34-1, for printing, in accordance with an embodiment of the present invention. The method associated with the flowchart of FIG. 5 may be implemented, for example, as program instructions executed by controller 18.

At act S100, it is determined whether the supply cartridge, e.g., ink tank 34-1, has been refilled.

For example, the memory device on the supply cartridge, e.g., memory device 56-1 of ink tank 34-1, may be used to record ink usage information relating to the depletion of the ink supply contained in the supply cartridge from full to its end of life. For example, by controller 18 counting the number of ink drops ejected from ink tank 34-1, and knowing the nominal ink drop volume and total original fill ink volume of ink tank 34-1, an amount of ink remaining in ink tank 34-1 may be calculated by controller 18 and stored as ink usage information in memory device 56-1. Also, the ink usage information may include a bit in memory device 56-1 that is designated to be set if the amount of ink in the original ink fill of ink tank 34-1 has been significantly depleted, i.e., ink tank 34-1 has been emptied.

Also, in embodiments wherein ink sensor 59 is an optical sensor, for example, optical methods implemented as program instructions executed by controller 18 may be used to detect whether there is free ink in free ink chamber 58. For example, ink sensor 59 may be in the form of an optical sensor positioned adjacent a window formed in a side wall of free ink chamber 58, and based on the optical characteristics detected, may indicate a presence or absence of free ink in free ink chamber 58.

If the ink usage information stored in memory device 56-1 indicates that ink tank 34-1 has been emptied, i.e., the ink supply has been significantly depleted, and ink sensor 59 does not detect free ink in free ink chamber 58, then ink tank 34-1 is assumed to have not been refilled, and any pending print job would not start since free ink chamber 58 is empty. However, if the ink usage information stored in memory device 56-1 indicates that ink tank 34-1 has been emptied, i.e., the ink supply has been significantly depleted, but ink sensor 59 detects free ink in free ink chamber 58, then ink tank 34-1 is assumed to have been refilled.

If the determination at act S100 is NO, then at act S102 the printing is performed at the normal ink ejection rate, e.g., at a 5 mg/sec ink ejection rate, and then the process ends. The normal ink ejection rate is a rate correlated to the normal print speed of imaging apparatus 14, such as for example, the normal velocity (speed) at which printhead carrier 30 reciprocates along bi-directional main scan direction (axis) 42. Thus, when printhead carrier 30 reciprocates at a normal printhead carrier velocity, the rate of ink ejection is at the normal ink ejection rate.

If the determination at act S100 is YES, then at act S104 the printing is performed at the refill ink ejection rate, i.e., the ink ejection rate is reduced from the normal ink ejection rate to a predetermined refill ink ejection rate. The amount of reduction of the ink ejection rate with respect to the normal ink ejection rate may be determined empirically (see, for example, the graphical plots of FIG. 4) to keep delivery pressures safely at or below the maximum sustainable delivery pressure to protect micro-fluid ejection device 36 of printhead assembly 32 (see, e.g., FIG. 4). The refill ink ejection rate is a rate correlated to a predetermined refill print speed of imaging apparatus 14, such as for example, the predetermined refill velocity (speed) at which printhead carrier 30 reciprocates along bi-directional main scan direction (axis) 42. The refill print speed is slower than the normal print speed. Thus, when printhead carrier 30 reciprocates at a refill printhead carrier velocity, the rate of ink ejection is at the refill ink ejection rate.

For example, the ink ejection rate for ink tank 34-1 after a refill, e.g., the refill ink ejection rate, may be reduced to a predetermined percentage, e.g., 30 percent, of the normal ink ejection rate of ink tank 34-1 at the original fill. This reduction in ink ejection rate to 30 percent of the normal ink ejection rate corresponds to a reduction in print speed to 30 percent of the normal print speed associated with the normal ink ejection rate. Thus, in the present example, the ink ejection rate will be reduced from the original ink ejection rate of 5 mg/sec to the refill ink ejection rate of 1.5. For the refilled ink tank 34-1, limiting the refill ink ejection rate to 30 percent of the normal (i.e., original fill) ink ejection rate helps to assure that the delivery pressures do not exceed the maximum sustainable delivery pressure (e.g., 10 $cmH_2O$) and thereby provides protection for micro-fluid ejection device 36 of printhead assembly 32 against excessive delivery pressures, and to helps prevent air ingestion through the ink jetting nozzles of micro-fluid election device 36.

Figure 6A:
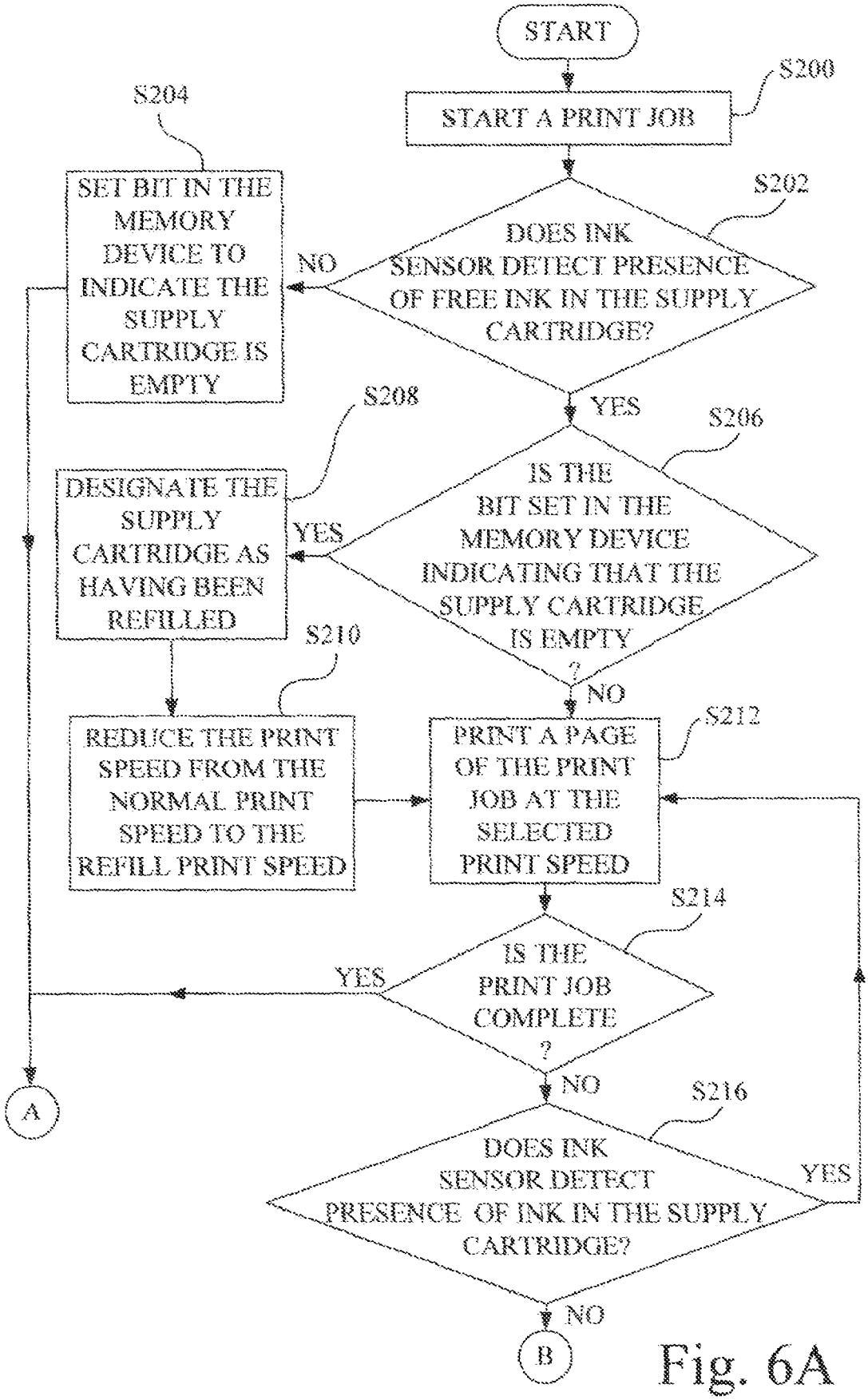
FIGS. 6A and 6B form a flowchart of a method for compensating for a refilled supply cartridge for printing, associated with another implementation of the present invention.
Figure 6B:
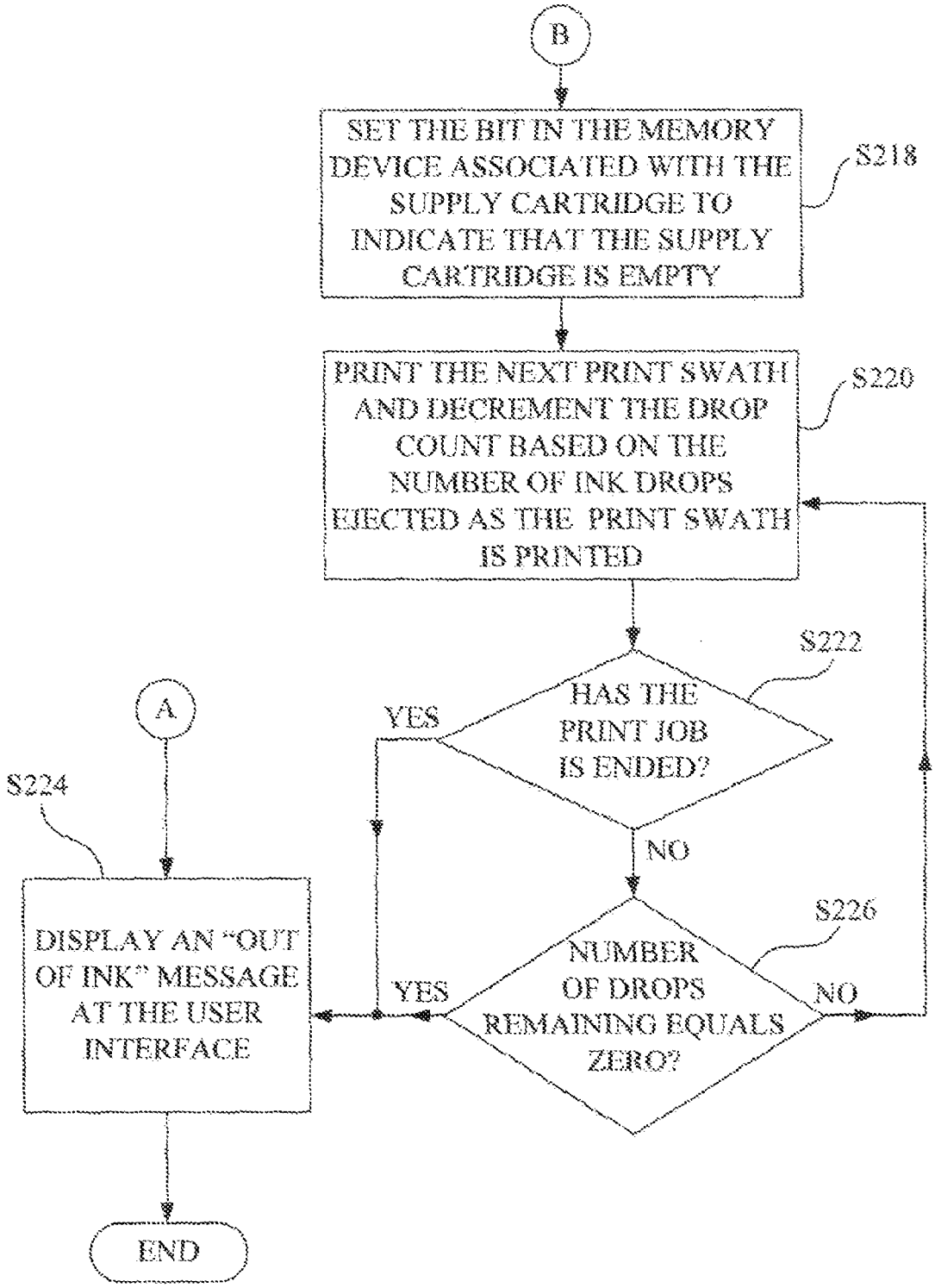

FIGS. 6A and 6B form a flowchart of a method for compensating for a refilled supply cartridge for printing, associated with another implementation of the present invention.

At act S200, a print job is started. The print job may be started, for example, by sending print data from host 12 to imaging apparatus 14. Initially, the print speed is set to the normal print speed.

At act S202, it is determined whether an ink sensor, e.g., ink sensor 59, detects the presence of free ink in the supply cartridge, e.g., ink tank 34-1.

If the determination at act S202 is NO, then the process proceeds to act S204.

At act S204 a hit is set in the memory device associated with the supply cartridge, e.g., memory device 56-1 of ink tank 34-1, to indicate that the supply cartridge is empty. The process continues to act S224. An "OUT OF INK" message is displayed, e.g., at user interface 22, after which the process ends. In other words, the print job is cancelled since there is no free ink available to complete the print job.

If the determination at act S202 is YES, indicating the presence of free ink in the supply cartridge, then the process proceeds to act S206.

At act S206, it is determined whether the bit in the memory device, e.g., memory device 56-1, indicating that the supply cartridge is empty is set, even though the presence of ink was detected at act S202.

If the determination at act S206 is YES, then the process proceeds to act S208.

At act S208 the supply cartridge, e.g., ink tank 34-1, is designated as having been refilled.

At act S210, with the supply cartridge having been determined to have been refilled, the print speed is reduced from a normal print speed to a refill print speed. In other words, the print speed is reduced from the normal print speed associated with the original fill to a refill print speed that is associated with the refilling of the supply cartridge. The print speed is reduced by an amount so as to reduce the ink ejection rate so as to not exceed the maximum sustainable delivery pressure, thereby protecting micro-fluid ejection device 36 of printhead assembly 32 against excessive delivery pressures, and reducing the possibility of air ingestion through the ink jetting nozzles of micro-fluid ejection device 36. The process then proceeds to act S212, with the print speed being at the refill print speed. In the previous example, the refill print speed is about 30 percent of the normal print speed used with the original fill of the supply cartridge.

If the determination at act S206 is NO, then the process proceeds to act S212, with the print speed being at the normal print speed.

At act S212, a page of the print job is printed at the selected print speed, e.g., at the refill print speed in the case of the supply cartridge being determined to have been refilled.

At act S214, it is determined whether the print job is complete.

If the determination at act S214 is YES, then the process ends.

If the determination at act S214 is NO, then the process proceeds to act S216.

At act S216, it is determined whether the ink sensor, e.g., ink sensor 59, detects the presence of free ink in the supply cartridge, e.g., ink tank 34-1. While act S216 will be performed at some point for each print job, the frequency at which act S216 is performed may be optional. For example, one may choose to check the ink sensor, e.g., ink sensor 59, after every page, or alternatively, for example, after every 5 pages, or only at the end of the print job.

If the determination at act S216 is YES, then the process returns to act S212 to print the next page at the selected print speed, e.g., at the refill print speed in the case of the supply cartridge being determined to have been refilled.

If the determination at act S216 is NO, then the process proceeds to act S218.

At act S218, the bit is set in the memory device associated with the supply cartridge, e.g., memory device 56-1 of ink tank 34-1, to indicate that the supply cartridge is empty. However, even though the ink sensor, ink sensor 59, now detects the absence of ink in the supply cartridge, e.g., ink tank 34-1, a reserve amount of suspended ink remains in ink suspension body 72 (e.g., felt) of suspended ink chamber 60. By experimentation, the reserve amount of ink may be represented in terms of a drop count, i.e., the number of ink drops remaining, and stored in the associated memory, e.g., memory device 56-1.

At act S220, the next print swath is printed, and the drop count is decremented based on the number of ink drops ejected as the print swath is printed.

At act S222, it is determined whether the print job is ended.

If the determination at act S222 is YES, then the process proceeds to act S224.

At act S224, an "OUT OF INK" message is displayed, e.g., at user interface 22, and the process ends.

If the determination at act S222 is NO, then the process proceeds to act S226.

At act S226, it is determined whether the number of drops remaining equals zero.

If the determination at act S226 is NO, then the process returns to act S220 for printing the next print swath.

If the determination at act S226 is YES, then the process proceeds to act S224, wherein the "OUT OF INK" message is displayed, e.g., at user interface 22, and the process ends.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method for adjusting the print delivery speed of a micro-fluid ejection device, comprising:

determining whether ink has been added to a supply cartridge after the supply cartridge has been installed in a printing device;

if ink has not been added to the supply cartridge, then performing printing at a first ink ejection rate; and if ink has been added to the supply cartridge, then performing printing at a second ink ejection rate.

2. The method of claim 1, said supply cartridge having a free ink chamber in fluid communication with a suspended ink chamber, and having a memory storing ink usage information, wherein said act of determining whether said supply cartridge has had ink added after the supply cartridge was installed includes:

determining whether a bit has been set in said memory indicating that an original supply of ink in said supply cartridge has been substantially depleted;

detecting whether any free ink is present in said free ink chamber, wherein:

if said bit is set and no free ink is detected in said free ink chamber then said supply cartridge is designated as having not been refilled, and if said bit is set and free ink is detected in said free ink chamber then said supply cartridge is designated as having been refilled.

3. The method of claim 1, wherein said second ink ejection rate is lower than said first ink ejection rate.

4. The method of claim 1, wherein said second ink ejection rate corresponds to a rate that allows a safe operation of a printhead associated with said supply cartridge.

5. The method of claim 1, wherein said second ink ejection rate is less than half of said first ink ejection rate.

6. The method of claim 1, wherein said supply cartridge is a removable ink tank.

7. A method for adjusting an ink ejection rate in a supply cartridge, comprising:

starting a print job with the supply cartridge installed in a printing device;

detecting whether free ink is present in the supply cartridge;

if free ink is detected, and a memory device associated with said supply cartridge indicates no free ink is available, then designating said supply cartridge as having had ink added to the supply cartridge post-installation;

adjusting a print speed from a first print speed associated to a second print speed;

printing a page of said print job at said second print speed;

again detecting whether free ink is present in a supply cartridge; and if no free ink is detected, utilizing a reserve amount of ink that remains in an ink suspension body of said supply cartridge to continue printing said print job at said second print speed.

8. The method of claim 7, wherein said reserve amount of ink is represented in said memory as a drop count, and wherein said drop count is decremented based on the number of ink drops ejected as a next print swath of said print job is printed.

9. The method of claim 8, wherein if said drop count indicates that said reserve amount of ink is depleted, then terminating said print job.

10. The method of claim 8, wherein if said drop count indicates that said reserve amount of ink is not depleted, then continuing with printing of a subsequent print swath.

11. An imaging apparatus, comprising:

a print engine having a printhead carrier;

a printhead assembly configured to be mounted to said printhead carrier;

a removable ink tank configured to be mounted to said printhead assembly, said removable ink tank including a free ink chamber and a suspended ink chamber, said suspended ink chamber having an ink output port and containing an ink suspension body, said suspended ink chamber being separated from said free ink chamber by a divider wall, said divider wall having an ink communication port to facilitate fluid communication between said free ink chamber and said suspended ink chamber, said ink output port being in fluid communication with said printhead assembly;

a memory associated with said removable ink tank; and a controller communicatively coupled to said print engine, said printhead assembly, and said memory, said controller executing program instructions for:

determining whether said removable ink tank has had ink added after the ink tank has been installed into a printing device, wherein:

if ink has not been added post-installation to the removable ink tank, then performing printing at a first ink ejection rate, and if ink has been added post-installation to said removable ink tank, then performing printing at a second ink ejection rate that is a lower rate than said first ink ejection rate.

12. The imaging apparatus of claim 11, wherein said act of determining whether said removable ink tank has had ink added post-installation, includes:

determining whether said memory has been written to indicating that an original supply of free ink in said removable ink tank has been depleted; and detecting whether any free ink is present in said free ink chamber, wherein if said bit is set and free ink is detected in said free ink chamber then said removable ink tank is designated as having had ink added after the ink tank has been installed in the printing device.

13. The imaging apparatus of claim 11, wherein said second ink ejection rate is less than half of said first ink ejection rate.

14. The imaging apparatus of claim 11, wherein said second ink ejection rate is about 30 percent of said first ink ejection rate.

15. The apparatus of claim 11, wherein said second ink ejection rate is a rate determined by a supplier of said ink tank to allow safe operation of said ink tank based on a presumption that ink has been added to the ink tank post-installation and air is likely trapped in the ink suspension body as a result of the ink addition.

16. The imaging apparatus of claim 11, wherein said first ink ejection rate is correlated to a first print speed and said second ink ejection rate is correlated to a slower print speed.

17. The imaging apparatus of claim 14, wherein said slower print speed is about 30 percent of said first print speed.

* * * * *